US006178862B1

(12) United States Patent
Liao

(10) Patent No.: US 6,178,862 B1
(45) Date of Patent: Jan. 30, 2001

(54) CUTTING TOOL ASSEMBLY IN COIL SPRING WINDING MACHINES

(76) Inventor: Chen-Nan Liao, No. 6, Lane 293, Hsin-Shu Rd., Hsin-Chuang City, Taipei Hsien (TW)

( * ) Notice: Under 35 U.S.C. 154(b), the term of this patent shall be extended for 0 days.

(21) Appl. No.: 09/174,320

(22) Filed: Oct. 19, 1998

(51) Int. Cl.[7] ..... B26D 5/16
(52) U.S. Cl. ..... 83/628; 83/646; 72/129
(58) Field of Search ..... 83/628, 642, 646, 83/527; 72/129, 130, 131, 132

(56) References Cited

U.S. PATENT DOCUMENTS 3,807,211 * 4/1974 Huhnen ..... 72/142
3,934,445 * 1/1976 Lampietti ..... 72/129
5,105,641 * 4/1992 Veit ..... 72/137
5,816,091 * 10/1998 Sautter et al. ..... 72/145

* cited by examiner

*Primary Examiner*—Rinaldi I. Rada
*Assistant Examiner*—T. Anthony Vaughn
(74) *Attorney, Agent, or Firm*—Rosenberg, Klein & Lee

(57) ABSTRACT

The present invention relates to a cutting tool assembly which can cut spring wires in either a vertical or a progress tilt direction in coil spring winding machines. This assembly uses a cam seat and a cam center guide seat for the cutting in a vertical direction. To do the cutting in a progressive tilt direction, the cam center guide seat is dismantled and the slide in the cam seat is fixed by screws. The cutting point can also be adjusted for the manufacture of special springs. This assembly provides a cheaper and an easy way for switching the cutting direction.

8 Claims, 12 Drawing Sheets

CUTTING TOOL ASSEMBLY IN COIL SPRING WINDING MACHINES

BACKGROUND OF THE INVENTION

1. Field of the Invention

The present invention relates to a cutting tool assembly in a coil spring winding machine. More particularly, this invention provides a cutting tool assembly which can cut spring wire in a fixed vertical direction or cut feeding wire in a progressive tilt direction which the cutter can be pivotablly driven by the feeding wire while the tip edge of the cutter is down to cut into 2. Description of the Related Art The conventional coil spring winding machines can cut the feeding wire only in a fixed vertical direction. The cutting in a vertical direction causes some drawbacks. One drawback is that the cut springs will have built-up sharp edges, which tend to damage some parts of the machine. Another drawback is that the capacity of the machine will be reduced because the momentum of the spring wire will slow down the release stroke of the cutting tool of the machine.

Some prior art devices are designed to solve the aforesaid drawbacks to equip two different set of cutting tool assemblies prepared for replacing onto the machine. However, the machine still has the defects as follows:

1. Although the machine can also cut the wire in a fixed vertical direction, operators must replace the cutting tool, slide and the transmission of the machine for different cutting direction. This replacement will take more time in spring manufacture.
2. The machine is more expensive than the conventional machines due to the cost of the cutting tool, slide and the transmission mechanisms.
3. The machine can cut the wire only in a fixed point, therefore, it is difficult to use the machine to manufacture springs with special shapes.

SUMMARY OF THE INVENTION

The present invention provides a new cutting tool assembly in a coil spring winding machine. This new assembly not only can cut the spring wire in either a vertical direction or a rotation direction, but also solve aforesaid drawbacks. The cutting direction can be switched in an easier and cheaper way by using a cam seat and a cam center guide seat to save time and cost. Furthermore, this assembly can adjust the cutting point for manufacturing special springs.

DETAILED DESCRIPTION OF THE PREFERRED EMBODIMENTS

Figure 1:
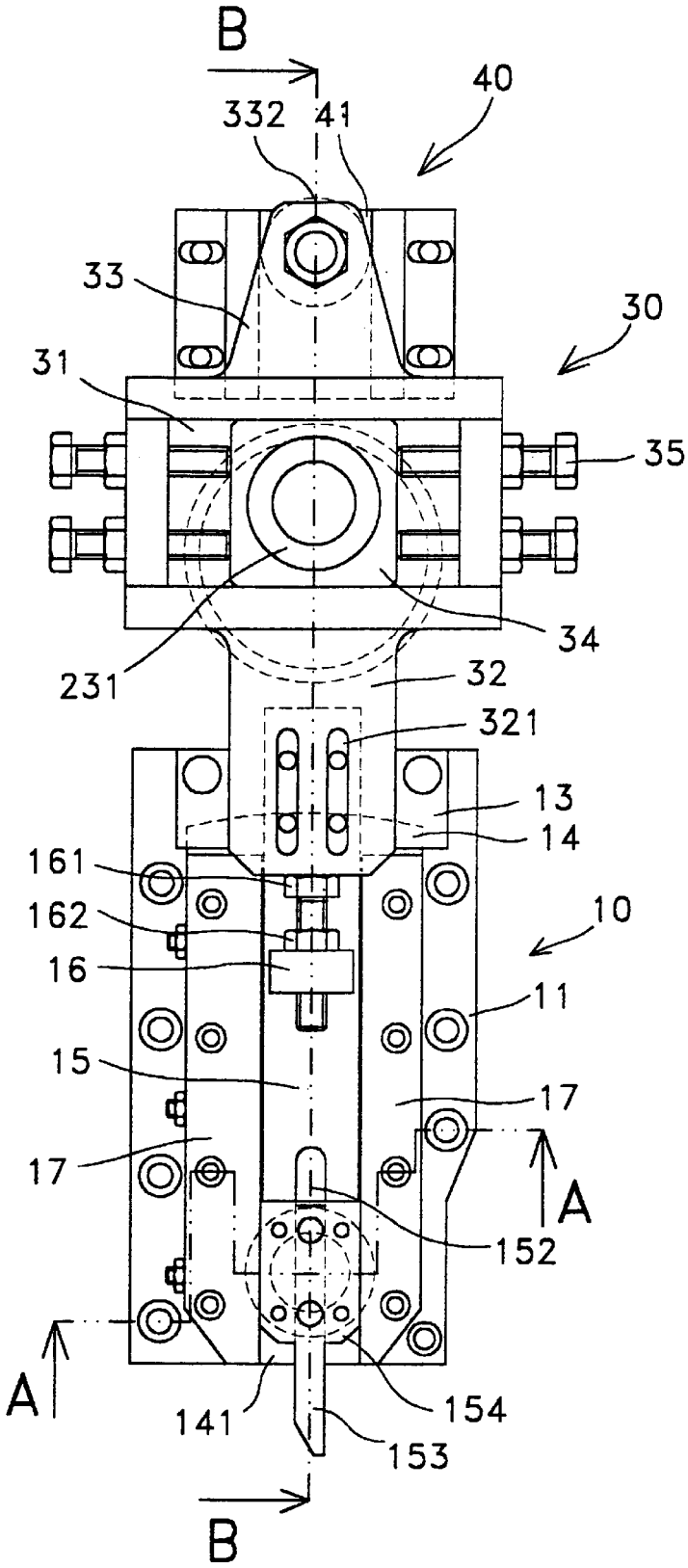
FIG. 1 shows the structure of the assembly according to the present invention.

Referring to FIG. 1, the cutting tool assembly in accordance with the present invention, is generally comprised of a tool rack 10, a cam seat 30 and a cam center guide seat 40.

Figure 1A:
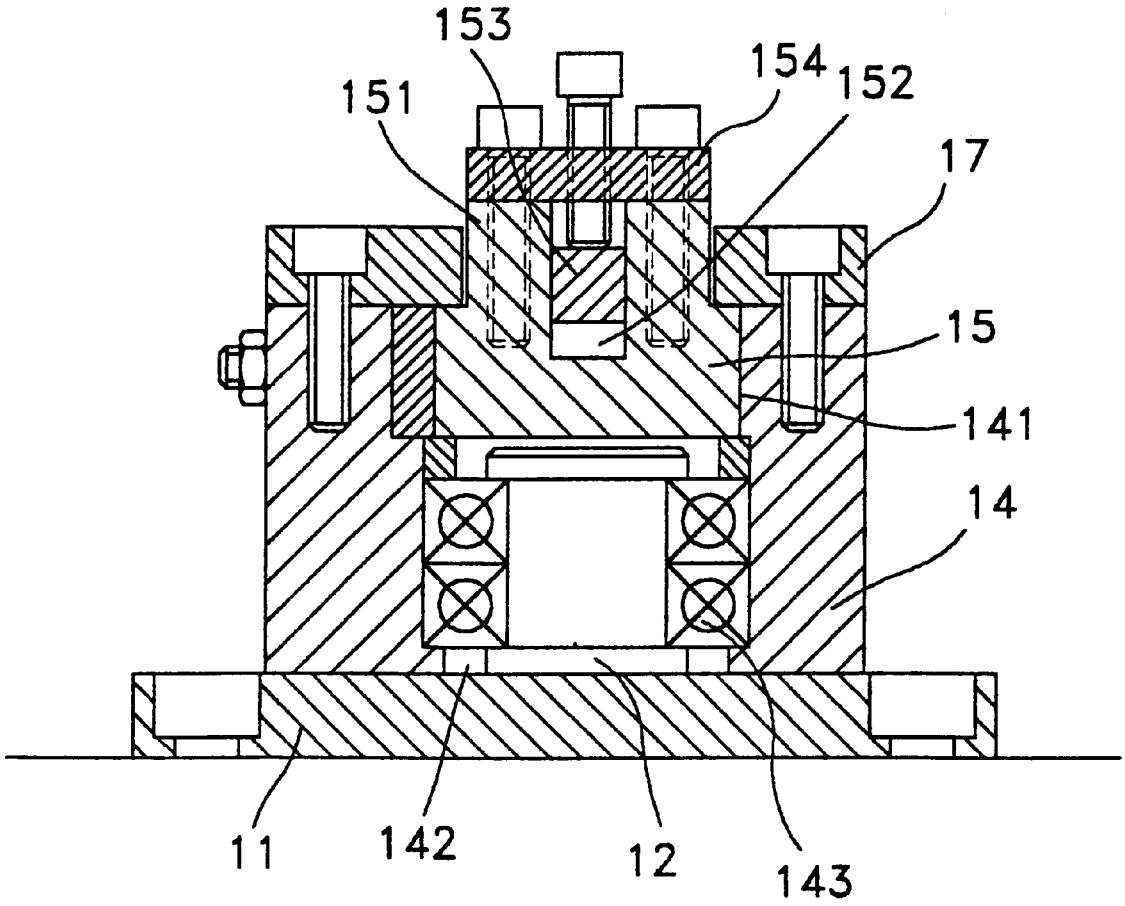
FIG. 1A is a sectional view taken along line A—A of FIG. 1.
Figure 1B:
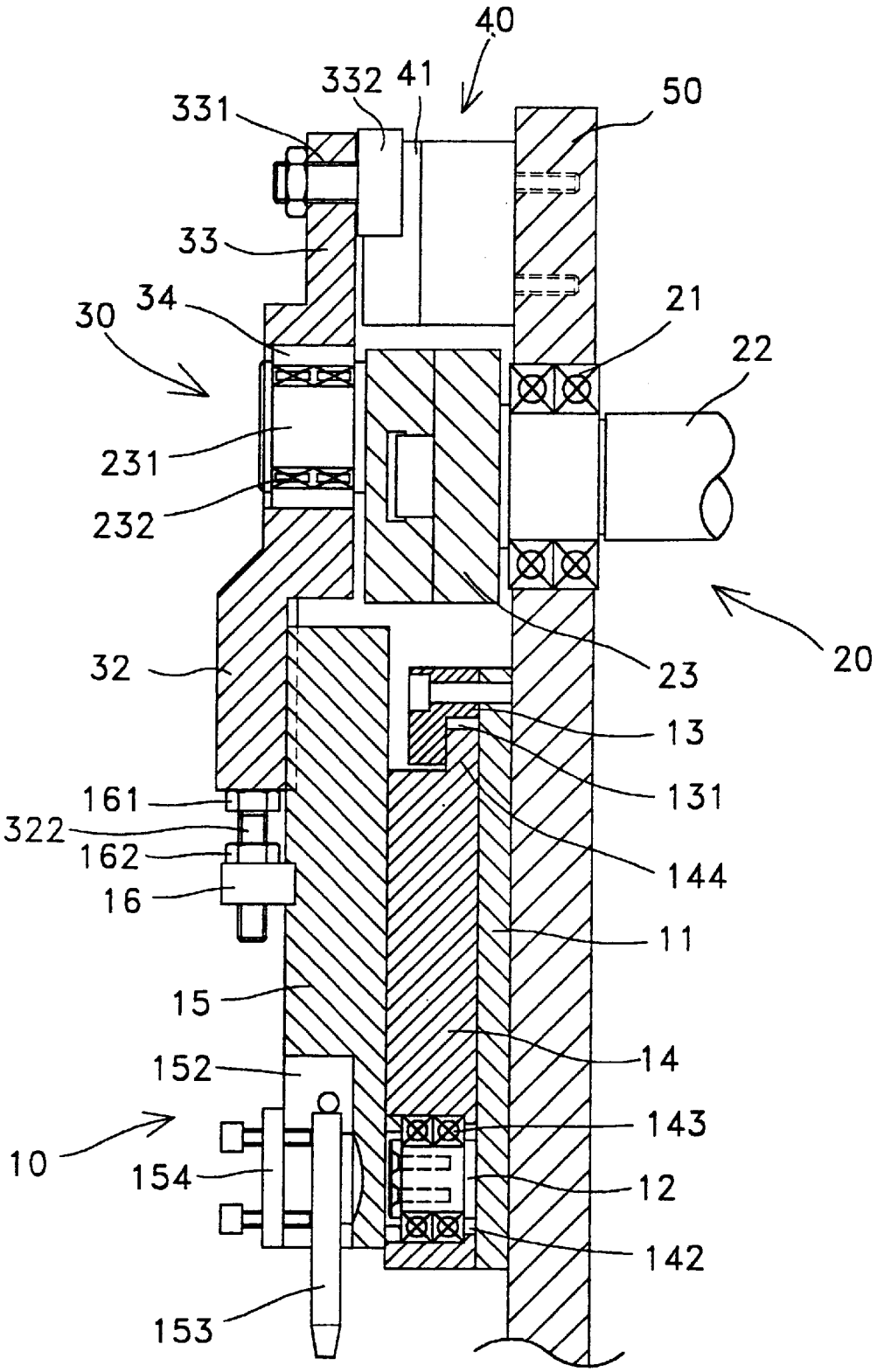
FIG. 1B is a sectional side view taken along line B—B of FIG. 1.

Referring to FIGS. 1, 1A and 1B, a tool rack 10 comprises a vertical base plate 11, a guide plate 13, a pivotable slide carrier 14, and a slide 15. The base plate 11 is a flat plate mounted on a vertical machine base 50 of the spring winding machine, having an axle stem 12 raised from the front side (opposite to the back side which is secured to the machine base 50) at a suitable location. The guide plate 13 is mounted on the top side of the base plate 11 remote from the axle stem 12, having a concave bottom recess 131. The slide carrier 14 comprises a circular through hole 142 near a bottom end coupled to the axle stem 12 of the base plate 11, a convex tail 144 at a top end fitted into the concave bottom recess 131 of the guide plate 13. A bearing 143 is located inside the hole 142 to permit the slide carrier 14 to pivot around the axle stem 12 in a certain angle. The slide carrier 14 has a longitudinal sliding groove 141 in which the slide 15 can move along. The slide 15 is a long block, having a rib block 151 in the middle, and having a fixed plate 17 at each side. The slide 15 is connected to the slide carrier 14 through the plate 17. The rib block 151 has a bottom recess 152 in which a cutting tool 153 is placed. A cover plate 154 is connected to the rib block 151, having a bolt to keep the cutting tool 153 inside the recess 152. An adjust seat 16 is located in the middle of the rib block 151, having a screw 161 and retaining nuts 162.

A transverse rail 31 located in a middle cam driven seat 30. A block plate 32 is located under the transverse rail 31, and a rib 33 is located on the upper side thereof Several guidances 321 are located in the middle of the block plate 32. Several tap holes are at one side of the rib block 151 to connect the block plate 32. The screw 161 is located below the block plate 32. The length of the screw 161 is chosen to adjust the distance between the seat 16 and the block plate 32, so that the cutting point of the cutting tool 153 can be adjusted. Inside the rail 31, there is a slide 34, and the slide 34 can move along the rail 31. There are several screws 35 placed at the opposite sides of the rail 31 for controlling the location of the block 34 in the rail 31.

A hole 331 is located in the middle of the rib 33. Behind the hole 331, there is a bearing 332 connected to the hole 331 by screw. A cam center guide seat 40 is mounted on the rib 33 and the machine base 50 by the bearing 332 and screws. There is a longitude rail 41 in the cam center guide seat 40, and the bearing 332 can move in the rail 41.

The cam seat 30 is driven by a transmission mechanism 20. The movement of the cam seat 30 causes the slide 15 to move along the slide carrier 14. The transmission mechanism comprises a bearing 21 placed in the machine base 50, a transmission shaft 22, and an eccentric wheel 23 mounted on the transmission shaft 22. The eccentric wheel 23 comprises an eccentric shaft 231 and a bearing 232 mounted on the eccentric shaft 231. The bearing 232 is placed in the middle of the slide 34.

Figure 2:
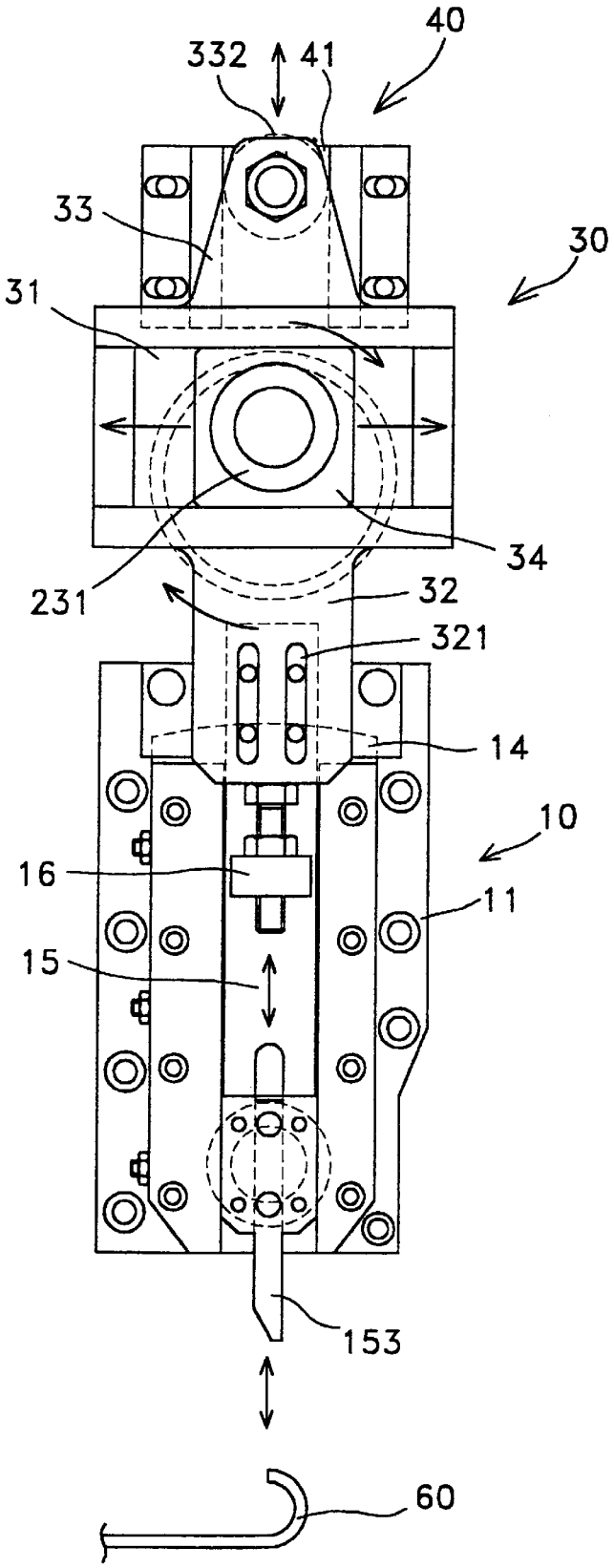
FIG. 2 illustrates the cutting in a vertical direction.

FIG. 2 illustrates the cutting in a vertical direction. To do the cutting in a vertical direction, the screws 35 will be dismantled. When the eccentric wheel 23 is driven by the transmission shaft 22, the slide 34 will be driven by the eccentric shaft 231 and move along the rail 31, but the cam seat 30 will not drive the slide carrier 14 in a rotation direction. Because of the cam center guide seat 40, the bearing 332 will move along the rail 41 in a longitude direction, and drive the cam seat 30, the slide 15, and the cutting tool also in a vertical direction.

Figure 3:
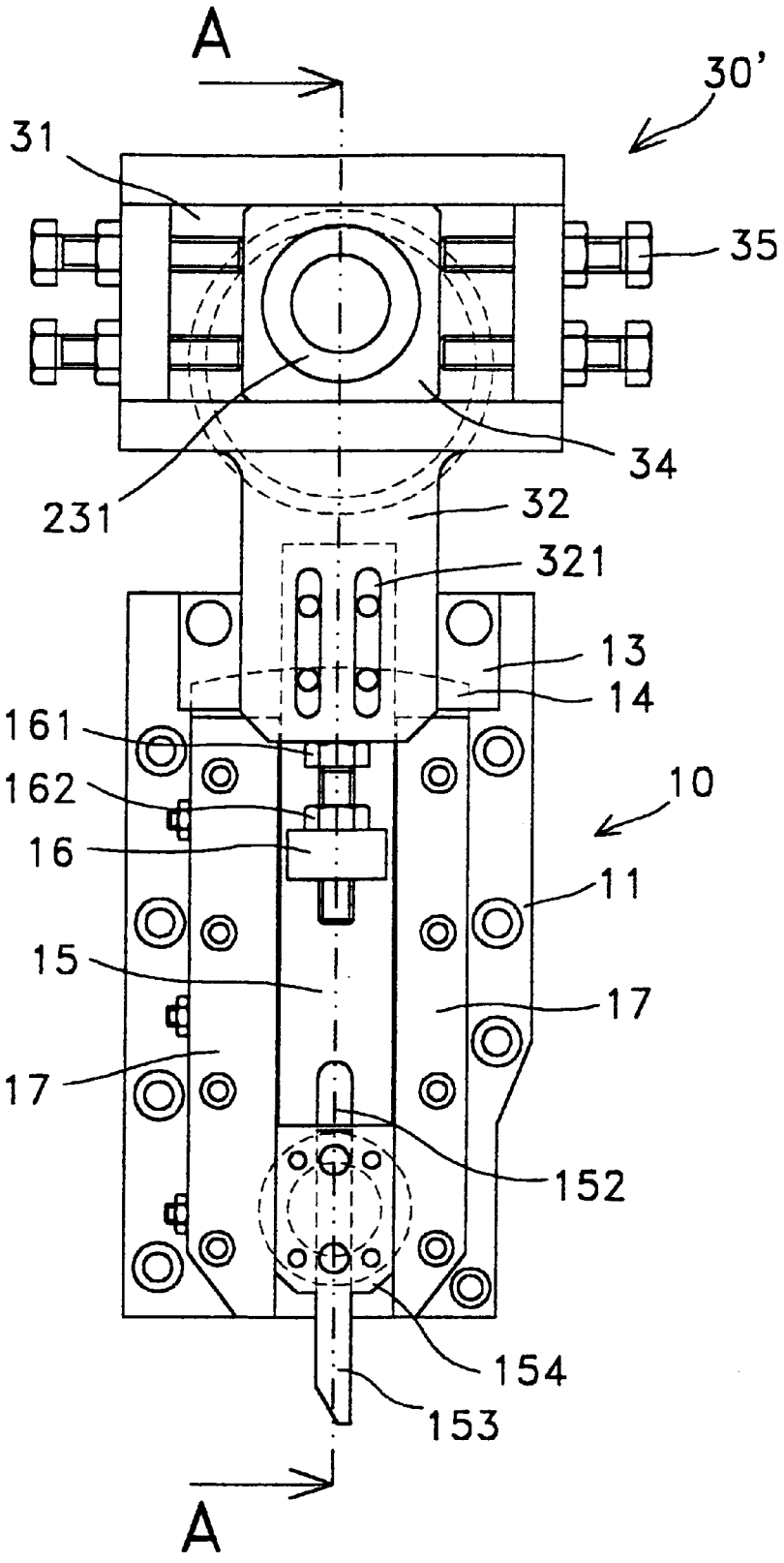
FIG. 3 illustrates the cutting by using one slide seat.
Figure 3A:
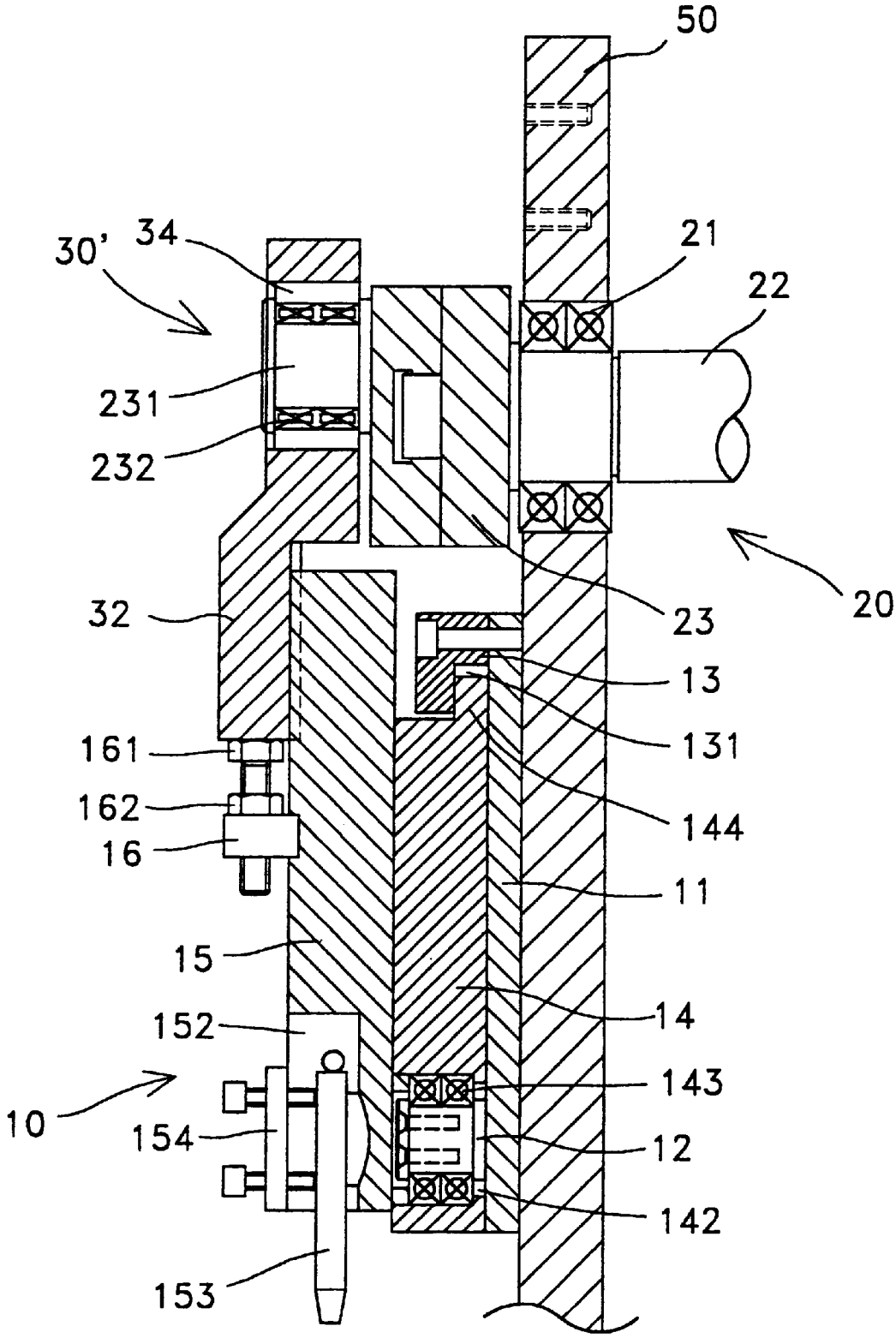
FIG. 3A is a sectional side view taken along line A—A of FIG. 3.
Figure 4:
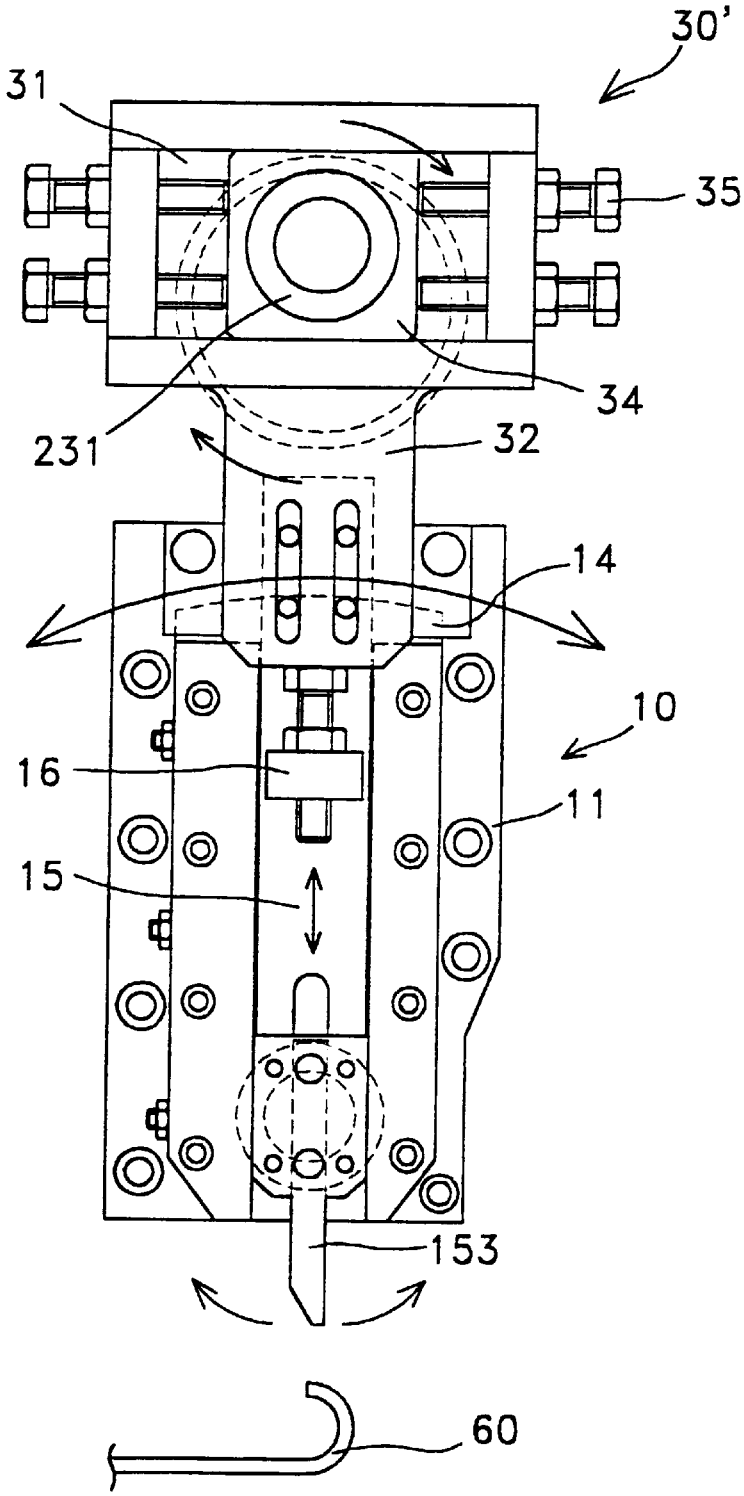
FIG. 4 illustrates the cutting in a pivotable direction.

FIGS. 3, 3A and 4 illustrate the cutting in a pivotable direction. To do the cutting in a pivotable direction, the cam center guide seat 40 will be dismantled from the assembly. The cam seat 30 or a new cam seat 30' without a rib can be used in this cutting. The slide 34 will be fixed in the rail 31 by the screws 35. When the eccentric wheel 23 and the eccentric shaft 231 are driven by the shaft 22, the slide 34 can not move along the rail 31, so the slide carrier 14 can be also driven by the eccentric shaft 231 and turn around the bearing 143 and drive the slide 15 and drive the cutting tool 153. The movement path of the cutting tool 153 is similar to an oval.

Figure 5:
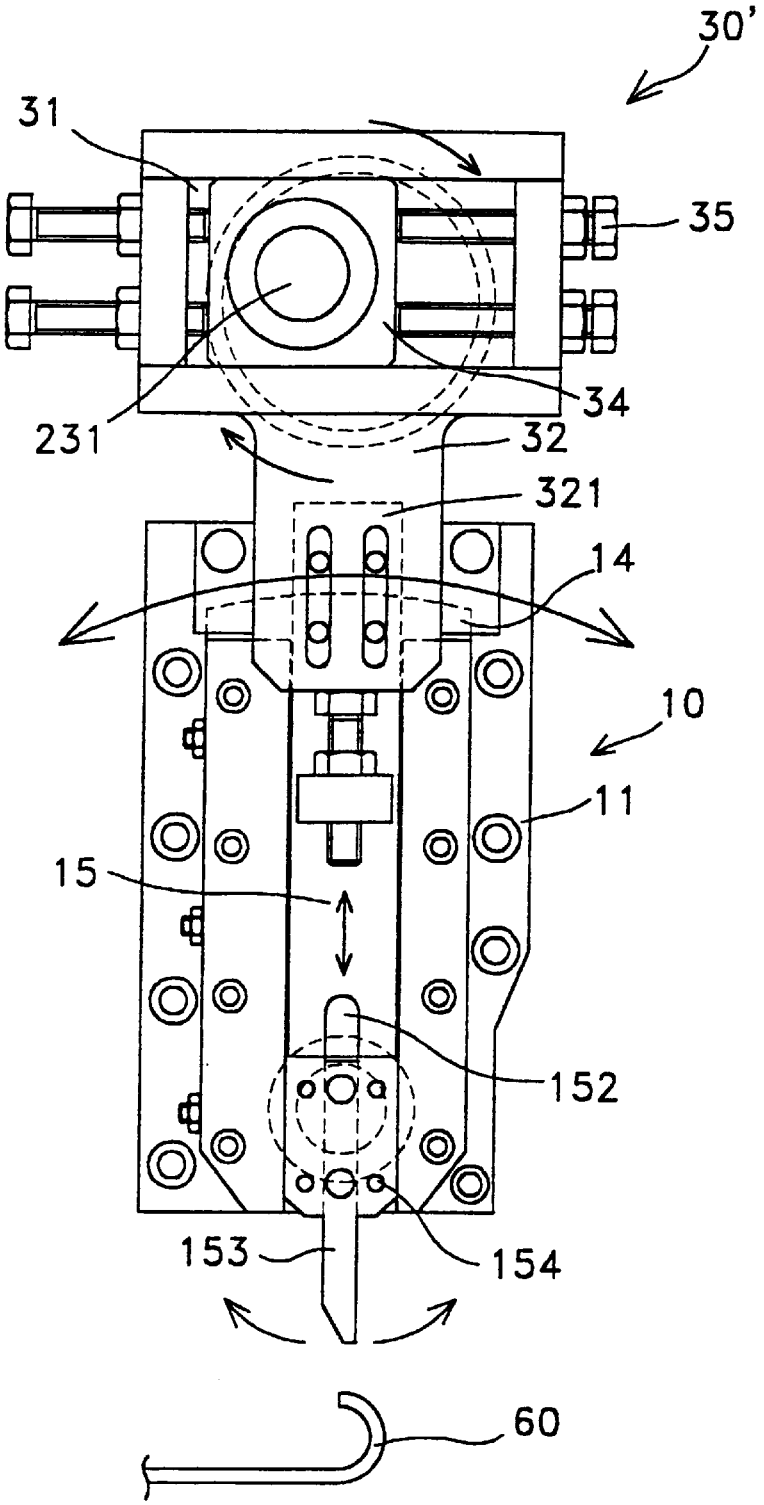
FIG. 5 illustrates the adjustment of the cutting point.

FIG. 5 illustrates how to adjust the cutting point. The location of the slide 34 in the rail 31 is adjusted by the screws 35, and the cutting point will be changed depend on the location of the slide 34.

Figure 6:
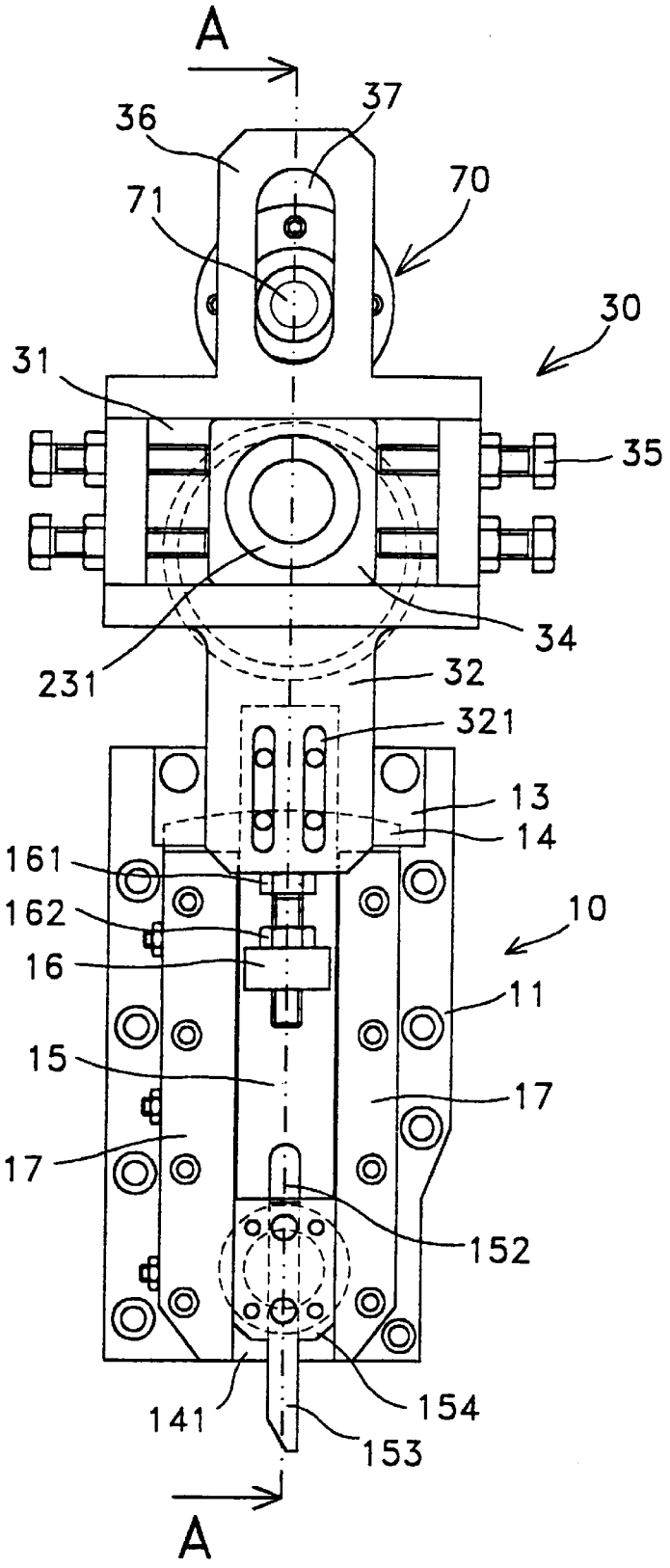
FIG. 6 illustrates the cutting by using different first slide seat.
Figure 6A:
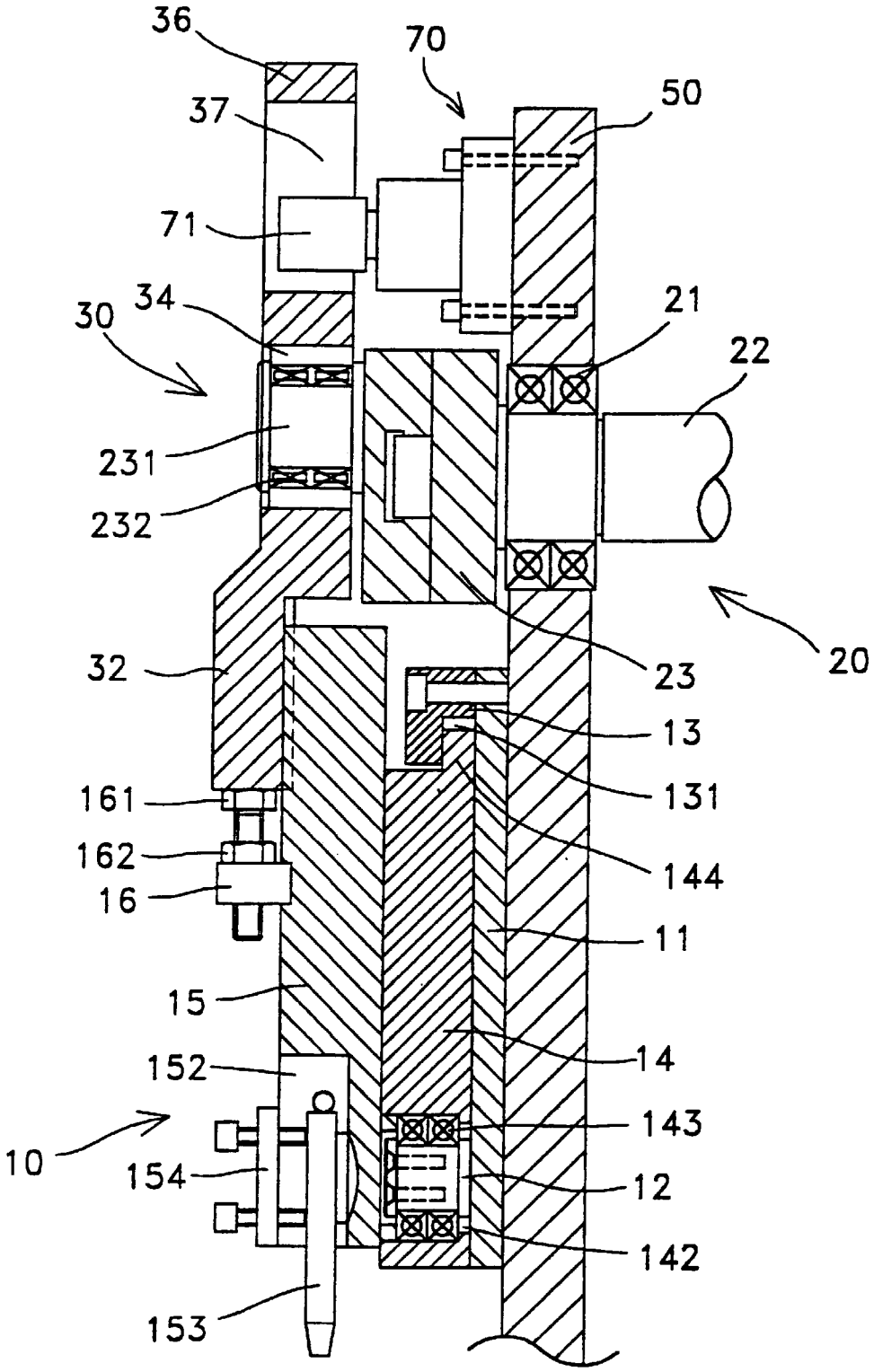
FIG. 6A is a sectional side view taken along line A—A of FIG. 6.
Figure 7:
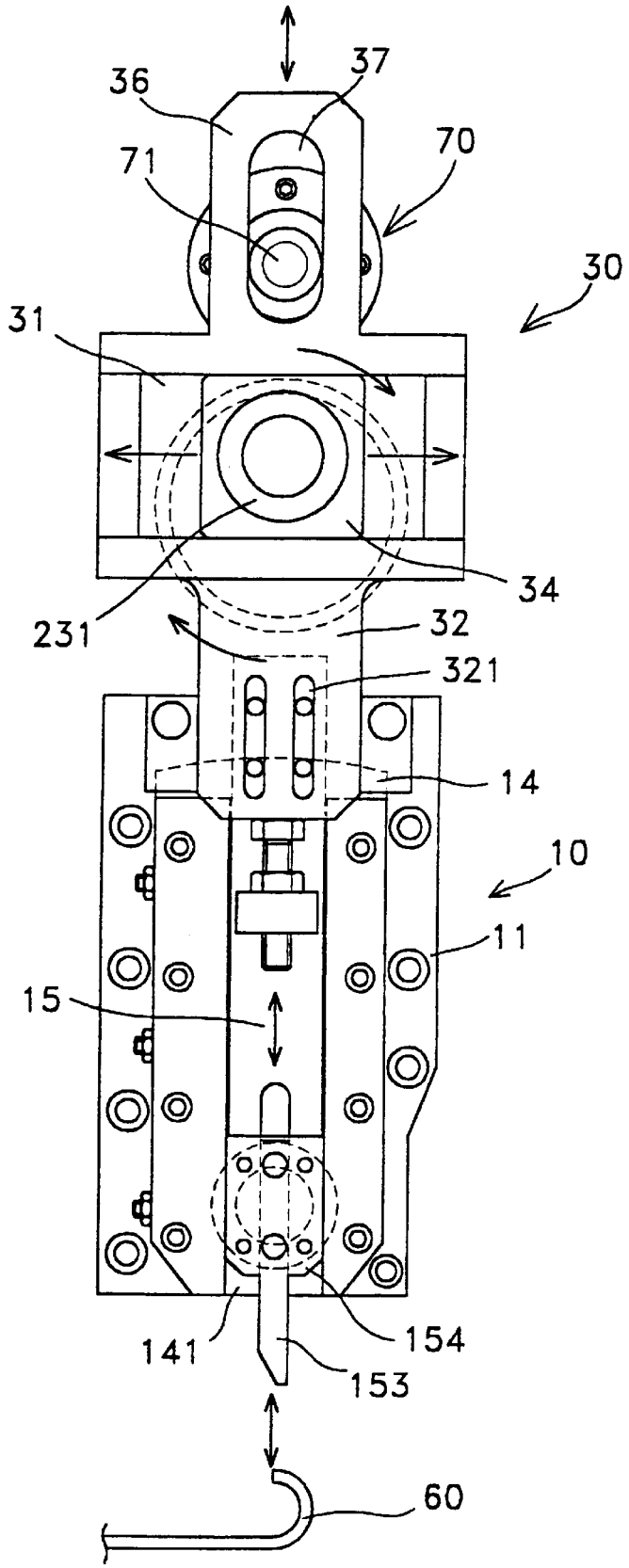
FIG. 7 illustrates the cutting by using different slide seats.
Figure 8:
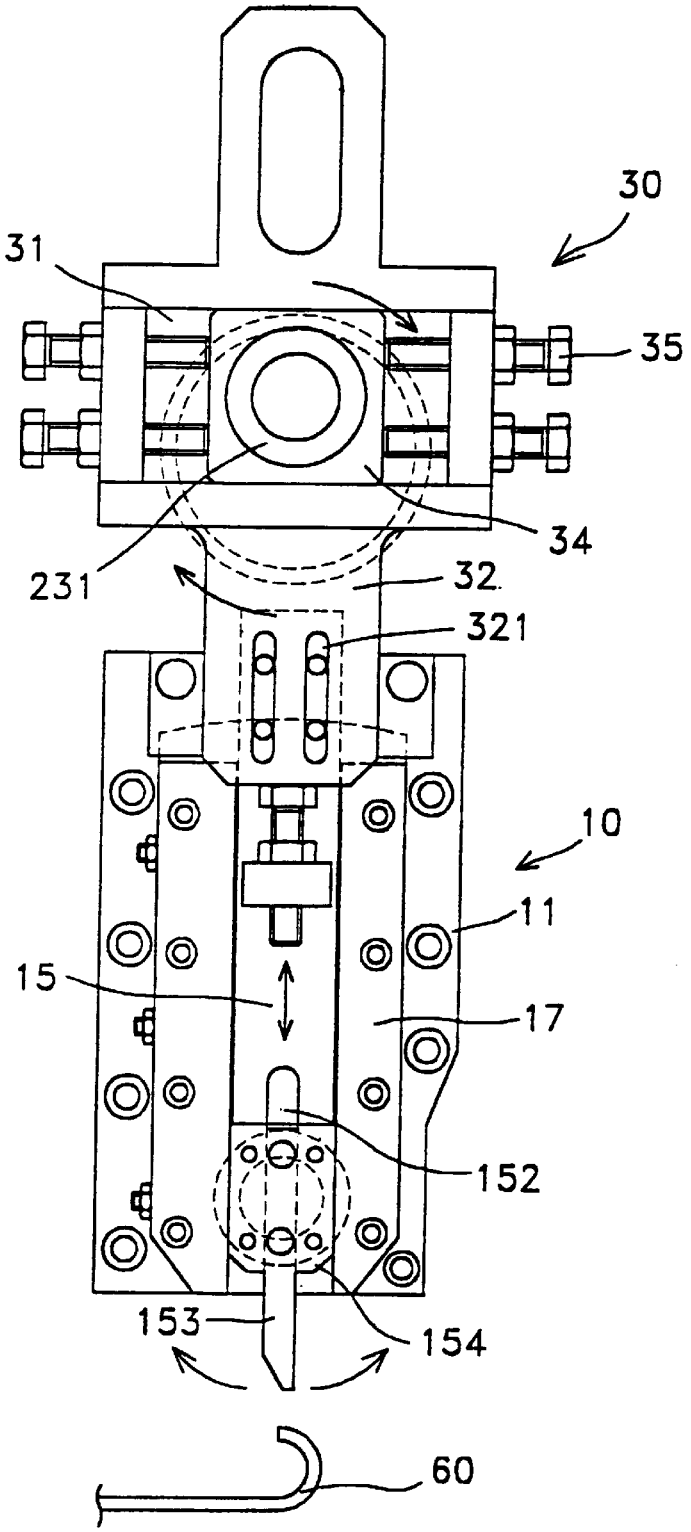
FIG. 8 illustrates the cutting in a rotation direction by using different first slide seat.

FIGS. 6 to 8 illustrate the cutting without the cam center guide seat 40. A new rib 36 replaces the rib 33 on the cam seat 30. In the middle of the rib 36, there is a longitude rail 37. A bearing 71 is placed in the rail 37 and is connected to a bearing base 70 which is fixed on the machine base 50. The bearing 71 can move vertically in the rail 37 and functions similarly to the cam center guide seat 40. To do the cutting in a vertical direction, the screws 35 are dismantled, as illustrated in FIG. 13. To do the cutting in a pivotable direction, the slide 34 is fixed by the screws 35 and the bearing 71 is dismantled, as illustrated in FIG. 8.

What is claimed is:

1. A cutting tool assembly able to cut spring wires in either a fixed vertical direction or a progressive tilt direction in coil spring winding machines, comprised of a machine base, a tool rack having (a) a vertical base plate mounted to said machine base, (b) a guide plate mounted to said vertical base plate, (c) a pivotable slide carrier coupled to said vertical base plate through a hole formed in said slide carrier, and (d) a slide displaceably mounted to said slide carrier, a first bearing disposed in said hole, a pair of fixed plates respectively mounted to said slide carrier on opposing sides of said slide, a cutting tool mounted to said slide, a cam seat coupled to said slide, a cam center guide seat mounted to said machine base, and a transmission mechanism drivingly coupled to said cam seat, said transmission mechanism including:

a first slide seat having a transverse rail and a rib and a block plate, said block plate having a plurality of guidances formed in a middle portion thereof, said slide having a plurality of tap holes formed therein for fixing to said first slide seat, said rail having another slide displaceable along the rail, said rib having a hole formed in a middle portion thereof, said hole having a second bearing mounted at a back side of said rib;

said cam center guide seat being connected to said rib and being mounted on said machine base, a second slide seat having a longitudinal rail for receiving said second bearing on said rib, said second bearing displaceable along said longitudinal rail; and said transmission mechanism driving said cam seat and said slide moving longitudinally in said slide carrier.

2. The cutting tool assembly able to cut spring wires in either a vertical direction or a progressive tilt direction in coil spring winding machines according to claim 1, wherein said rib has an adjust seat in a middle, said adjust seat having a screw rod and two retaining nuts, and said screw rod located below said block plate.

3. The cutting tool assembly able to cut spring wires in either a vertical direction or a progressive tilt direction in coil spring winding machines according to claim 1, wherein said transmission mechanism has a bearing, a transmission shaft through said bearing, an eccentric wheel mounted on said transmission shaft, said eccentric wheel having an eccentric shaft, said eccentric shaft placed in a middle of said slide.

4. The cutting tool assembly able to cut spring wires in either a vertical direction or a progressive tilt direction in coil spring winding machines according to claim 3, wherein a bearing is mounted on said eccentric shaft and placed in a middle of said slide.

5. A cutting tool assembly able to cut spring wires in either a vertical direction or a progressive tilt direction in coil spring winding machines, comprised of a machine base, a tool rack having (a) a vertical base plate mounted to said machine base, (b) a guide plate mounted to said vertical base plate, (c) a pivotable slide carrier coupled to said vertical base plate through a hole formed in said slide carrier, and (d) a slide displaceably mounted to said slide carrier, a bearing disposed in said hole, a pair of fixed plates respectively mounted to said slide carrier on opposing sides of said slide, a cutting tool mounted to said slide, a cam seat coupled to said slide, and a transmission mechanism drivingly coupled to said cam seat;

said cam seat having a transverse rail and a rib and a block plate, said block plate having a plurality of guidances formed in a middle portion thereof, said slide having a plurality of tap holes formed therein for fixing to said cam seat, said rail having another slide displaceable along the rail, said slide carrier having a guidance formed in a middle portion thereof, a bearing base mounted on said machine base, a bearing disposed on said bearing base; and said transmission mechanism driving said cam seat and said slide moving longitudinally in said slide carrier.

6. The cutting tool assembly able to cut spring wires in either a vertical direction or a progressive tilt direction in coil spring winding machines according to claim 5, wherein said rib has an adjust seat in the middle, said adjust seat having a screw and a nut, and said screw located below said block plate.

7. The cutting tool assembly able to cut spring wires in either a vertical direction or a progressive tilt direction in coil spring winding machines according to claim 5, wherein said transmission mechanism is mounted on said machine base and having a bearing, a transmission shaft through said bearing, an eccentric wheel mounted on said transmission shaft, said eccentric wheel has an eccentric shaft, said eccentric shaft placed in the middle of said slide.

8. The cutting tool assembly able to cut spring wires in either a vertical direction or a progressive tilt direction in coil spring winding machines according to claim 7, wherein a bearing is mounted on said eccentric shaft and placed in a middle of said slide.

* * * * *